United States Patent [19]

Cooper

[11] 4,063,416

[45] Dec. 20, 1977

[54] STEAM GENERATOR

[76] Inventor: Jack M. Cooper, Box 913, Okmulgee, Okla. 74447

[21] Appl. No.: 637,239

[22] Filed: Dec. 3, 1975

[51] Int. Cl.[2] ..... F03G 7/00

[52] U.S. Cl. ..... 60/641; 60/670; 166/256; 166/257; 48/DIG. 6

[58] Field of Search ..... 60/641, 670, 643, 645; 166/256, 257, 260, 261, 79, 92; 48/DIG. 6

[56] References Cited

U.S. PATENT DOCUMENTS

| | | | |
|---|---|---|---|
| 3,379,248 | 4/1968 | Strange | 60/641 |
| 3,473,610 | 10/1969 | Lange | 166/261 |
| 3,933,447 | 1/1976 | Pasini et al. | 166/256 X |

*Primary Examiner*—Allen M. Ostrager
*Attorney, Agent, or Firm*—John N. Randolph

[57] ABSTRACT

An apparatus and method of burning fossile fuels, such as coal, in their places of natural deposit, for producing energy which may be utilized for various purposes, such as, for driving an electric generator.

5 Claims, 2 Drawing Figures

STEAM GENERATOR

BACKGROUND

Much time and expense is involved in removing burnable fossile fuels from the earth in order that such fuels may be utilized for producing energy.

SUMMARY

It is a primary object of the present invention to conserve a substantial part of the time and expense involved in obtaining fossile fuels to be used in producing energy, by burning such fossile fuels in place.

More particularly, it is an object of the present invention to provide an apparatus which may be utilized for burning a seam of coal in the earth and for utilizing the heat produced by the burning coal above ground for any purpose such as for driving a generator to produce electricity.

Another object of the invention is to provide a novel method of burning fossile fuel deposits heat and utilizing the energy thus produced above ground as a power source.

Various other objects and advantages of the invention will hereinafter become more fully apparent from the following description of the drawing, illustrating a presently preferred embodiment thereof, and wherein:

DESCRIPTION OF THE PREFERRED EMBODIMENTS

Figure 1:
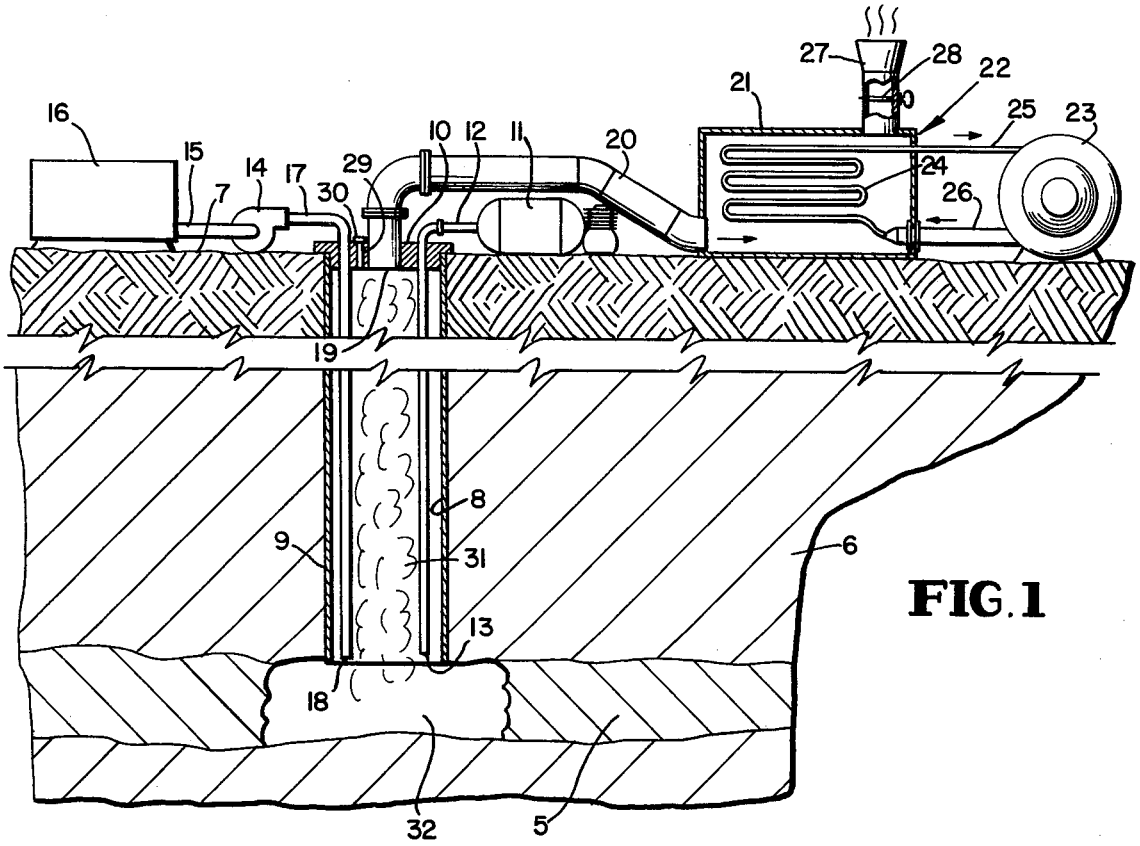
FIG. 1 is a vertical sectional view, primary in elevation, illustrating one embodiment of the apparatus of the invention for utilizing the energy produced by burning coal in the earth for producing steam to drive an electric generator disposed above ground.

Referring more specifically to the drawing, FIG. 1 illustrates one embodiment of the invention involving a novel apparatus and method for utilizing the energy obtainable from underground fossile fuels, such as a seam of coal 5, without removing the coal from its place of deposit in the earth 6, substantially below the earth's surface 7. As seen in FIG. 1, a hole 8 is drilled through the earth 6 from its surface 7 to a part of the seam of coal 5 and a casing 9 is applied to the drilled hole to line the wall thereof. A plug or cap 10 closes and substantially seals the upper end of the casing 9.

An air compressor 11, which is mounted above the earth's surface 7, has a pipe 12 leading from the outlet thereof and which extends downwardly through a part of the cap 10. The pipe 12 extends downwardly from the cap 10 through the cased hole 8 and has its lower discharge end 13 terminating adjacent a part of the coal seam 5.

A water pump 14 has a pipe 15 connected to the inlet thereof and which leads from a tank, reservior or other suitable source of water supply 16.The parts 14, 15 and 16 are disposed above the earth's surface 7. A pipe 17 leads from the outlet of the pump 14 and extends downwardly through the cap 10 and through the cased drilled hole 8. The discharge end 18 of the pipe 17 terminates above and adjacent a part of the fossile fuel seam 5.

A downturned end 19 of a pipe 20 is mounted in an opening of the cap 10 and opens into the bore hole 8. The other, discharge end of the pipe 20 opens into one end of a heat exchanger casing 21.A conduit 22 has end portions leading through the other end of casing 21 and connecting with a steam driven electric generator 23 to form an endless conduit system. Conduit 22 has a lapped portion 24 disposed in a vertical plane in the casing 21. An extension 25 of the upper leg of portion 24 connects with the generator 23. An enlarged opposite end 26 of conduit 22 extends between the lower lap of portion 24 and a lower part of generator 23. An exhaust pipe 27 extends upwardly from the heat exchanger 21 and has a damper 28.

A bore 29 extends through the cap 10 and is normally closed and sealed at its upper end by a removable plug 30. The plug 30 is removed so that an igniting means, not shown, may be inserted through the bore 29 and lowered or dropped onto the fossile coal seam 5 for igniting the part thereof communicating with and disposed directly beneath the bore hole 8. The igniting means can be a burning taper, a burning oil soaked rag, or an electrical means which could be lowered through the bore hole 8 to the fuel 5 and thereafter removed when the coal or other fossile fuel is burning sufficiently. After this has been accomplished, the plug 30 is replaced for sealing the bore 29. Air is furnished to the burning fuel through the pipe 12 from the compressor 11 to promote burning of the fuel, the products of combustion from which rise through the bore hole 8 and pass through the pipe 20 into the heat exchanger casing 21.

When the fuel 5 is burning sufficiently, operation of the pump 14 is begun for supplying water from the source 16 through the pipe 17 to the burning fuel. The water is converted to steam 31 which rises through the hole 8 into and through the pipe 20 and into the casing 21. The steam 31 in the casing 21 will heat the lapped portions 24 of the conduit 22, which contains water, for converting this water to steam, not shown, which passes through the outlet end 25 of the conduit 22 into the electric generator 23 for driving said generator. This steam when condensed returns as water to the lapped portions 24 through the outer end 26 of the conduit 22. The damper 28 can be adjusted to regulate the escape of the steam 31 and other products of combustion from the burning coal 32 through the stack 27.

The amount of water supplied to the burning fuel will not be sufficient to extinguish the fire and for this reason the outlet end 18 of the pipe 17 may be located at any desired distance above the burning fuel, as indicated at 32, so that the steam 31 rising from the burning fuel 32 will preheat the water before it reaches the fire. In addition, the outlet 18 could be in the form of a spray-head from which a fine spray could be discharged.

The primary purpose of the heat exchanger is to protect the generator 23 from contamination caused by the steam 31. The smoke and other products of combustion will pass upwardly with the steam 31 through the pipe 20 into the casing 21 and be exhausted through the stack 27. Some coal gas will be exhausted with the products of combustion and which can be burned after leaving the casing 21 and utilized as another energy source.

The pump and its associated parts could be omitted and the heat exchanger could include a boiler containing water which would be heated by the products of combustion from the burning fuel to produce steam for driving the generator 23.

If desired, both air and water could be supplied to the burning fuel through the pipe 12.

Figure 2:
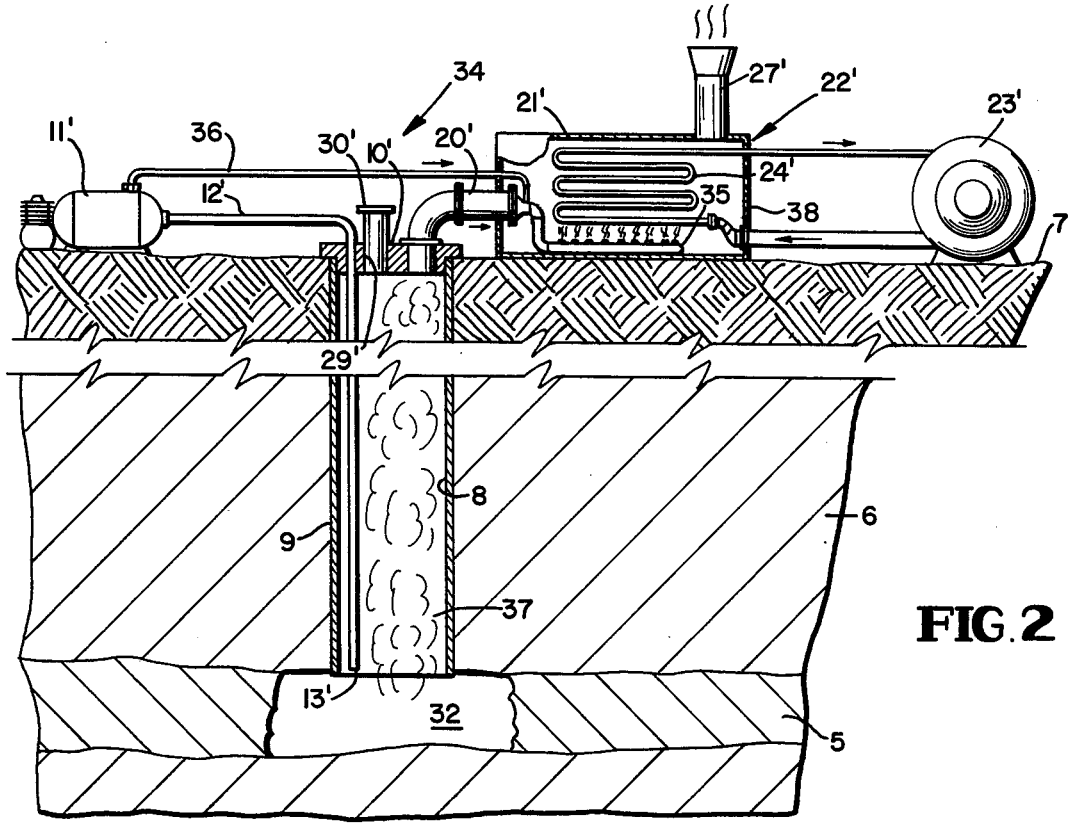
FIG. 2 is a view similar to FIG. 1, illustrating another embodiment of the invention utilizing heat and gas from the burning coal to produce steam to drive an electric generator disposed above ground.

FIG. 2 illustrates another embodiment of the invention, designated generally 34, which includes parts 5, 6, 7, 8 and 9. The apparatus 34 includes a somewhat modified cap 10', an air compressor 11' and a pipe 12' leading from the compressor 11' to adjacent the coal seam 5 where the discharge end 13' of the pipe 12' is located. A modified conduit 20' has one end opening into the bore casing 8 and its other end connecting with a gas burner 35 which is disposed in a casing 21' which substantially corresponds with the casing 21 and includes a stack 27'. A pipe 36 leads from the compressor 11' to the conduit 20', adjacent the burner 35. A conduit 22', which substantially corresponds to the conduit 22, connects with a steam driven electric generator 23', in the same manner that the conduit 22 is connected with the generator 23. The lapped portion 24' of the conduit 22' is disposed in the casing 21' above the burner 35.

The cap 10' has a bore 29' normally closed by a plug 30' which is removed, so that the part 32' of the coal seam 5, located beneath the bore 9, can be ignited in the manner as heretofore described in reference to the apparatus of FIG. 1. Air is supplied to the burning coal 32 to promote combustion. The products of combustion, as indicated at 37, which include coal gas, together with the heat from the burning coal 32, will rise through the casing 8 and pass through the pipe 20' to the burner 35. Casing 21' is equipped with an access door 38 which can be opened for lighting the burner 35. The heat from the burning coal gas 37 and the air supplied through the pipe 36 to said gas, together with the heat from the burning coal, which escapes from the burner 35, will heat the lapped portion 24' to produce steam for driving the generator 23', in the same manner as previously described in reference to the apparatus of FIG. 1. The products of combustion from the burner 35 will escape through the stack 37'.

It will be noted that the reservoir 16, pump 14 and conduits 15 and 17 are omitted from the embodiment of FIG. 2.

Various modifications and changes are contemplated and may be resorted to, without departing from the function or scope of the invention.

I claim as my invention:

1. An apparatus for utilizing fossile fuels still in the ground as an energy source, comprising a bore hole extending from the earth's surface to underground fossile fuel, a cap closing the upper end of said hole, a first conduit leading from above ground through said cap to adjacent the fuel, said cap having a bore through which an igniter can be utilized for igniting the fuel, a closure for sealing said cap bore after the fuel is ignited, means supplying air from above the earth's surface through said first conduit to the burning fuel, a second conduit opening into the bore hole through said cap to receive heat from the burning fuel, an electric generator, and a heat exchanger connected to said second conduit and to the generator for utilizing the heat to drive the generator.

2. An apparatus as in claim 1, a third conduit extending from above ground through said cap, and means supplying water through said third conduit to be converted to steam by the burning fuel and constituting a part of the heat supplied to the heat exchanger.

3. An apparatus as in claim 1, a gas burner disposed in said heat exchanger and connected to said second conduit for burning coal gases passing from the bore hole through said second conduit for supplying heat to the heat exchanger.

4. An apparatus as in claim 2, said heat exchanger including a casing into which said second conduit discharges, and means for regulating a discharge of the steam and products of combustion from said casing.

5. An apparatus as in claim 1, said second conduit having an inlet end disposed in said cap.

* * * * *